US007218309B2

(12) United States Patent
Uchino et al.

(10) Patent No.: US 7,218,309 B2
(45) Date of Patent: May 15, 2007

(54) DISPLAY APPARATUS INCLUDING PLURAL PIXEL SIMULTANEOUS SAMPLING METHOD AND WIRING METHOD

(75) Inventors: Katsuhide Uchino, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 89 days.

(21) Appl. No.: 10/271,198

(22) Filed: Oct. 15, 2002

(65) Prior Publication Data

US 2003/0107561 A1 Jun. 12, 2003

(30) Foreign Application Priority Data

Oct. 17, 2001 (JP) ..... 2001-319266

(51) Int. Cl.
*G09G 3/36* (2006.01)

(52) U.S. Cl. ..... 345/103; 345/204; 345/100

(58) Field of Classification Search ..... 345/96, 345/98, 100, 209, 103, 204
See application file for complete search history.

(56) References Cited

U.S. PATENT DOCUMENTS 5,253,091 A * 10/1993 Kimura et al. ..... 345/94
5,959,600 A * 9/1999 Uchino et al. ..... 345/94
6,157,358 A * 12/2000 Nakajima et al. ..... 345/96
6,545,655 B1 * 4/2003 Fujikawa ..... 345/87
2003/0025658 A1 * 2/2003 Janssen et al. ..... 345/87

FOREIGN PATENT DOCUMENTS

JP 11-249627 * 9/1999

* cited by examiner

*Primary Examiner*—Sumati Lefkowitz
*Assistant Examiner*—Rodney Amadiz
(74) *Attorney, Agent, or Firm*—Robert J. Depke; Rockey, Depke, Lyons & Kitzinger LLC.

(57) ABSTRACT

A display apparatus employing a plural pixel simultaneous sampling method is disclosed wherein the parasitic capacitance of each wiring line is reduced to suppress a ghost. A sampling switch set includes switches which are connected to corresponding ones of signal lines and video lines. Upper and lower side horizontal drive circuits drive switches of the sampling switch set simultaneously to sample the video signals of systems to the corresponding signal lines, and perform sampling successively for each signal lines to write the video signals into pixels of the selected row. The video lines are divided into two groups of video lines disposed on the upper and lower sides. The upper side video lines are connected to corresponding even-numbered ones of the signal lines through the corresponding switches while the lower side video lines are connected to corresponding odd-numbered ones of the signal lines through the corresponding switches.

10 Claims, 6 Drawing Sheets

PRIOR ART

DISPLAY APPARATUS INCLUDING PLURAL PIXEL SIMULTANEOUS SAMPLING METHOD AND WIRING METHOD

This application claims priority to Japanese Patent Application Number JP2001-319266 filed Oct. 17, 2001 which is incorporated herein by reference.

BACKGROUND OF THE INVENTION

This invention relates to an active matrix display apparatus, and more particularly to improvements in or relating to a display apparatus that adopts a "plural pixel simultaneous sampling method" of writing a video signal at a time into a plurality of pixels.

FIG. 4 shows a typical example of a conventional active matrix display apparatus. Referring to FIG. 4, the display apparatus 0 shown includes a pixel array section 9, a horizontal drive circuit 6, a pair of vertical drive circuits 4, and a precharge drive circuit 8. The pixel array section 9 includes gate lines 1 extending in the direction of a row, signal lines 2 extending in the direction of a column, and pixels 3 disposed at points at which the gate lines 1 and the signal lines 2 intersect with each other. The vertical drive circuits 4 are disposed in a leftward and rightward separated relationship from each other and line-sequentially drive the gate lines 1 from the opposite sides to successively select the pixels 3 in a unit of a row. The horizontal drive circuit 6 is connected to the signal lines 2 and samples a video signal supplied thereto from the outside to the signal lines 2 thereby to write the video signal into the selected row of the pixels 3. In this instance, usually "dot sequential driving" of successively writing the video signal into the individual pixels is used. Also the precharge drive circuit 8 is connected to the signal lines 2. Where the dot sequential driving is used and the video signal to be written into the pixels is inverted for each one row, if charging/discharging current upon sampling of the video signal to the signal line 2 provided for each column of the pixel array section 9 is high, then this appears as a "vertical stripe" on the display screen. In order to suppress the charging/discharging current upon sampling of a video signal as low as possible, a precharge signal supplied through a precharge line is applied to the signal lines 2 in the precharge drive circuit 8 prior to dot sequential writing of a video signal. The precharging is performed prior to dot sequential writing of a video signal into the pixels 3 and samples the precharge signal to the signal lines 2 similarly in a dot-sequential fashion.

In an active matrix display apparatus which adopts the dot sequential driving scheme, in order to raise the resolution of a panel, the number of pixels is increased. As a result of increase of the number of pixels, if the dot sequential driving is performed one by one pixel, then the writing time of a video signal to be allocated to one pixel becomes short. In order to cope with this, a plurality of video lines are provided in the panel to input a plurality of video signals, and the video signals are sampled at a time to a plurality of pixels to obtain a sufficient writing period of time. In this instance, it is necessary to adjust the phases of the plurality of systems of video signals relative to one another in advance. According to the conventional standards (XGA, SXGA) for an active matrix display apparatus, the simultaneous sample number is 12. However, as the rise of the resolution of pixels further proceeds, it becomes impossible to assure a sufficient writing period of time with the simultaneous sample number of 12. For example, the UXGA standards adopt simultaneous sampling of 24 pixels. A layout of video lines in this instance is shown in FIG. 5.

Referring to FIG. 5, the display apparatus shown includes a pixel array section which in turn includes gate lines 1 extending in the direction of a row, signal lines 2 extending in the direction of a column, and pixels 3 disposed in rows and columns at points at which the gate lines 1 and the signal lines 2 intersect with each other. In the arrangement shown in FIG. 5, each of the pixels 3 is formed from a thin film transistor (TFT) and a liquid crystal cell LC. The gate electrode of the thin film transistor TFT is connected to the corresponding gate line 1, and the source electrode is connected to the corresponding signal line 2 while the drain electrode is connected to one of electrodes (pixel electrode) of the corresponding liquid crystal cell LC. A predetermined counter potential is applied to the other electrode (counter electrode) of the liquid crystal cell LC. The vertical drive circuit 4 is connected to the gate lines 1 and sequentially select the rows of the pixels 3. The panel includes 24 video lines SIG1 to SIG24 laid thereon, and 24 systems of video signals are supplied in a predetermined phase relationship to the panel. In the arrangement shown in FIG. 5, the 24 video lines SIG1 to SIG24 are laid between the pixel array section and the horizontal drive circuit 6. A sampling switch set is disposed between the flux of the horizontal lines SIG1 to SIG24 and the signal lines in the columns. The sampling switch set includes units of 24 switches HSW connected between units of 24 signal lines and the 24 video lines SIG1 to SIG24. The horizontal drive circuit 6 includes a shift register having multiple stages and operates in response to a clock signal HCK supplied thereto from the outside to successively transfer a start pulse HST supplied thereto from the outside similarly to successively output drive pulses A, B, . . . from the successive stages of the shift register. The horizontal drive circuit 6 drives 24 switches HSW at a time with each one of the drive pulses to sample the 24 systems of video signals SIG1 to SIG24 to the corresponding 24 signal lines 2. The horizontal drive circuit 6 performs such sampling successively for the different sets of 24 signal lines 2 and writes the video signals SIG1 to SIG24 into the pixels 3 of the selected row. In the following description, a video signal and a video line may be referred to with a same reference character SIG (SIG1 to SIG24).

A precharge line PSIG is laid between the pixel array section and the precharge drive circuit 8 shown below the pixel array section in FIG. 5 and supplies a precharge signal PSIG of a predetermined level from the outside. Also the precharge line and the precharge signal may be referred to with a same reference character. Another sampling switch set is disposed between the single precharge line PSIG and the signal lines 2 extending in the columns. Similarly to the switches HSW for writing video signals, the switches PSW for writing a precharge signal are driven to open or close in a unit of 24 switches HSW by the precharge drive circuit 8. Accordingly, the precharge drive circuit 8 has a configuration similar to that of the horizontal drive circuit 6 and includes a shift register having multiple stages. The shift register operates in response to a clock signal PCK supplied thereto from the outside and successively transfers a precharge start pulse PST supplied thereto from the outside similarly to successively outputs drive pulses A', B', . . . .

FIG. 6 illustrates operation of the display apparatus shown in FIG. 5. Referring to FIG. 6, the precharge start pulse PST is inputted first, and then the horizontal start pulse HST is inputted consecutively. Further, the operation clock signal HCK supplied to the horizontal drive circuit 6 and the precharge operation clock signal PCK supplied to the precharge drive circuit 8 have a pulse train of an equal frequency. The precharge drive circuit 8 transfers the precharge start pulse PST in response to the precharge operation clock signal PCK to successively output the drive pulses A', B', C', . . . for the switches PSW. Consequently, 24 switches PSW in each set are driven simultaneously to successively write a precharge signal into the corresponding signal lines 2. Concurrently, the horizontal drive circuit 6 operates in response to the operation clock signal HCK to successively transfer the horizontal start pulse HST to successively output the drive pulses A, B, C, . . . for the switches HSW. Consequently, the video signals are successively sampled in a unit of 24 signal lines 2. Since the precharge start pulse PST precedes to the horizontal start pulse HST, sampling of the precharge signal is performed preceding to the sampling of the video signals.

A subject to be solved by the present invention is described below with reference back to FIG. 5. Generally, a parasitic capacitance appears between intersecting wiring lines in a panel. Particularly where the simultaneous sampling method is used, each of the 24 video liens SIG1 to SIG24 extends in an intersecting relationship with the signal lines 2, and the capacitance at each of the intersecting portions is applied as a parasitic capacitance to each of the video lines SIG1 to SIG24. As the parasitic capacitance of each video line increases, the video signal SIG becomes blunt, which makes a cause of a display defect called ghost. If the simultaneous sample number is doubled, then also the parasitic capacitance is doubled, and such blunt deformation of a video signal pulse as described above becomes worse and the ghost margin decreases. Particularly where the dot line inverse driving method is used, the polarities of video signals supplied to adjacent video lines are opposite to each other. Therefore, the capacitance value felt by each video line further increases and the ghost margin is further deteriorated, and this is a subject to be solved.

SUMMARY OF THE INVENTION

It is an object of the present invention to provide a display apparatus employing a plural pixel simultaneous sampling method wherein the parasitic capacitance of each wiring line is reduced to suppress a ghost.

In order to attain the object described above, according to the present invention, there is provided a display apparatus, including a pixel array section including a plurality of gate lines extending in a direction of a row, a plurality of signal lines extending in a direction of a column, and a plurality of pixels arranged in rows and columns at points at which the gate lines and the signal lines intersect with each other, a vertical drive circuit connected to the gate lines for successively selecting the rows of the pixels, n video lines divided into two upper and lower side groups of n/2 video lines disposed on the upper and lower sides of the pixel array section, respectively, for supplying video signals of n systems separated in a predetermined phase relationship from each other, a sampling switch set including a plurality of switches divided into two upper and lower side groups disposed on the upper and lower sides of the pixel array section for the signal lines such that the switches are grouped into units of n switches in each of which the n switches are connected to a unit of n ones of the signal lines and the upper side n/2 video lines are connected to corresponding ones of the signal lines through the switches of the upper side group while the lower side n/2 video lines are connected to corresponding ones of the signal lines through the switches of the lower side group, and a pair of upper and lower side horizontal drive circuits for successively driving the switches of the sampling switch set for each n signal lines such that each n/2 ones of the switches of the upper side group are driven simultaneously to sample the video signals of n/2 systems from the upper side n/2 video lines to the n/2 switches to write the video signals into the pixels of the selected row while each n/2 ones of the switches of the lower side group are driven simultaneously to sample the video signals of n/2 systems from the lower side n/2 video lines to the n/2 switches to write the video signals into the pixels of the selected row.

Preferably, one of each two adjacent ones of the signal lines is connected to one of the video lines of the upper side group while the other of the two adjacent signal lines is connected to one of the video lines of the lower side group. In this instance, each of the gate lines in the pixel array section may be disposed for a unit of two rows of the pixels between a pair of adjacent ones of the columns of the pixels, and the upper and lower side horizontal drive circuits may write video signals of the opposite polarities to each other to adjacent ones of the pixels connected to a same gate line through the corresponding ones of the signal lines. In this instance, the upper side horizontal drive circuit may sample the video signals of a same polarity from the video lines of the upper side group to corresponding ones of the signal lines while the lower side horizontal drive circuit samples the video signals of a same polarity from the video lines of the lower side group to corresponding ones of the signal lines thereby to suppress the level of parasitic capacitance to be felt by each of the upper and lower side video lines to raise a margin against ghost.

Preferably, the display apparatus further includes a pair of upper and lower side precharge lines disposed on the upper and lower sides of the pixel array section each for supplying a predetermined precharge signal, and the upper side horizontal drive circuit applies the precharge signal from the upper side precharge line through switches to those of the signal lines which correspond to the upper side horizontal drive circuit while the lower side horizontal drive circuit applies the precharge signal from the lower side precharge line through switches to those of the signal lines which correspond to the lower side horizontal drive circuit.

In the display apparatus, the video lines provided on a panel of the display apparatus are divided into two groups which are laid out on the upper and lower sides in the inside of the panel. In a corresponding relationship, also the switches of the sampling switch set and the horizontal drive circuits are disposed separately on the upper and lower sides, and the upper and lower side video lines are inputted to the upper and lower side horizontal drive circuits, respectively. With the layout of the display apparatus described, the number of signal lines which overlap with each of the video lines decreases to one half that of a conventional display apparatus. Consequently, also the parasitic capacitance decreases to one half, and therefore, a blunt of the video signals can be suppressed and the ghost margin can be increased.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
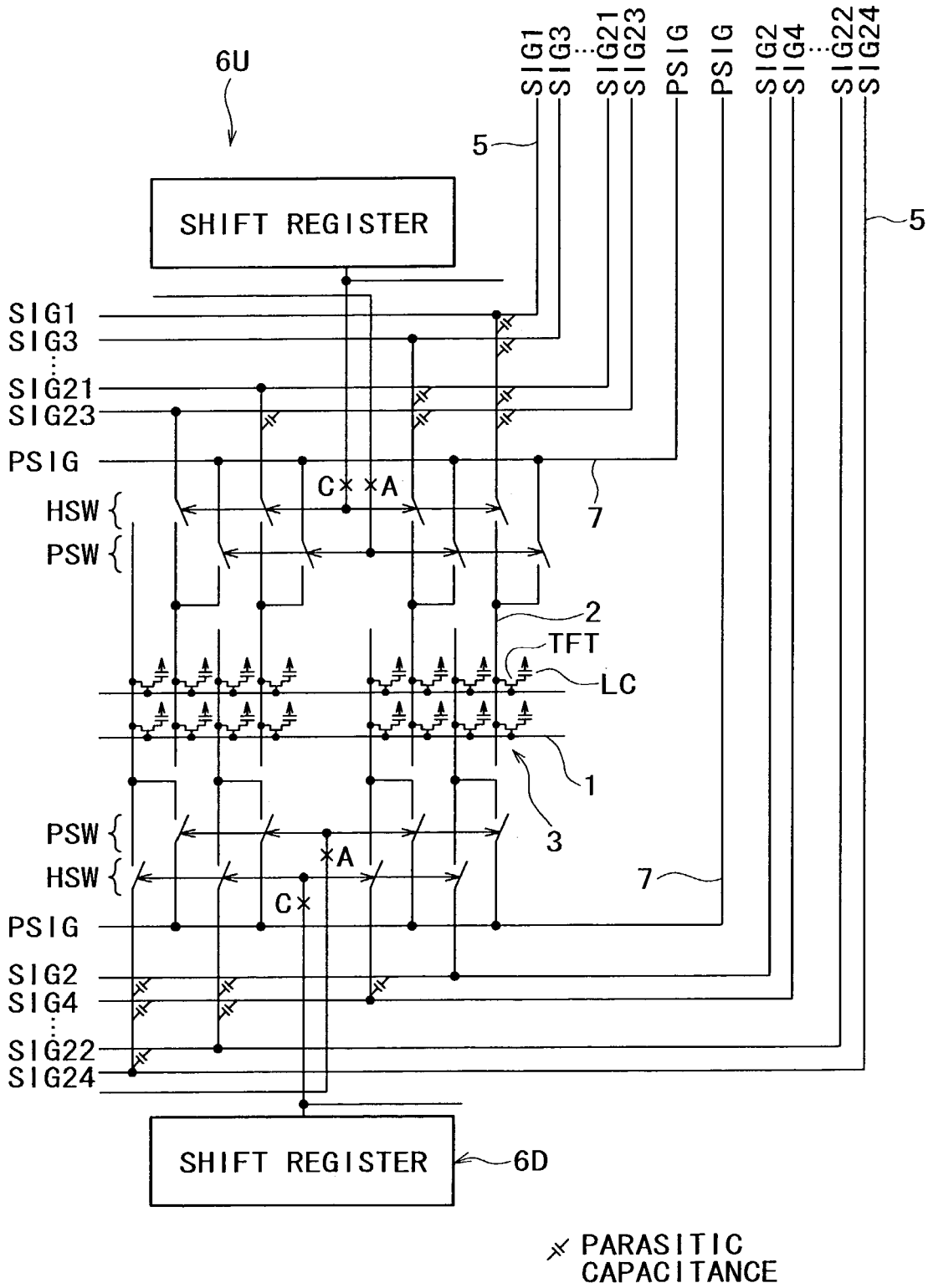
FIG. 1 is a circuit diagram showing a display apparatus to which the present invention is applied.
Figure 4:
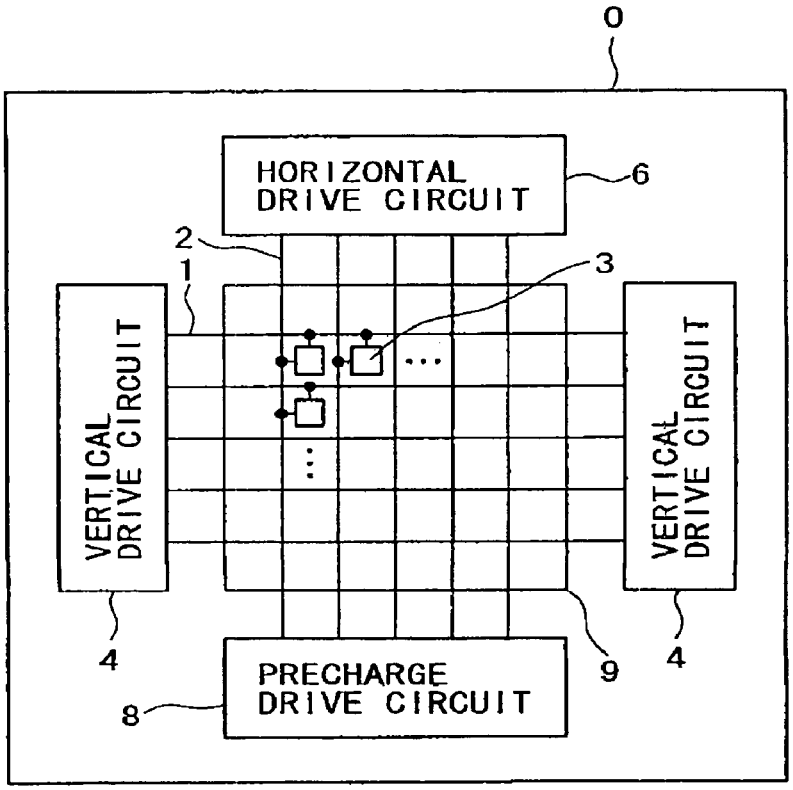
PRIOR ART F I G. 4
FIG. 4 is a block diagram showing a typical example of a conventional display apparatus.
Figure 5:
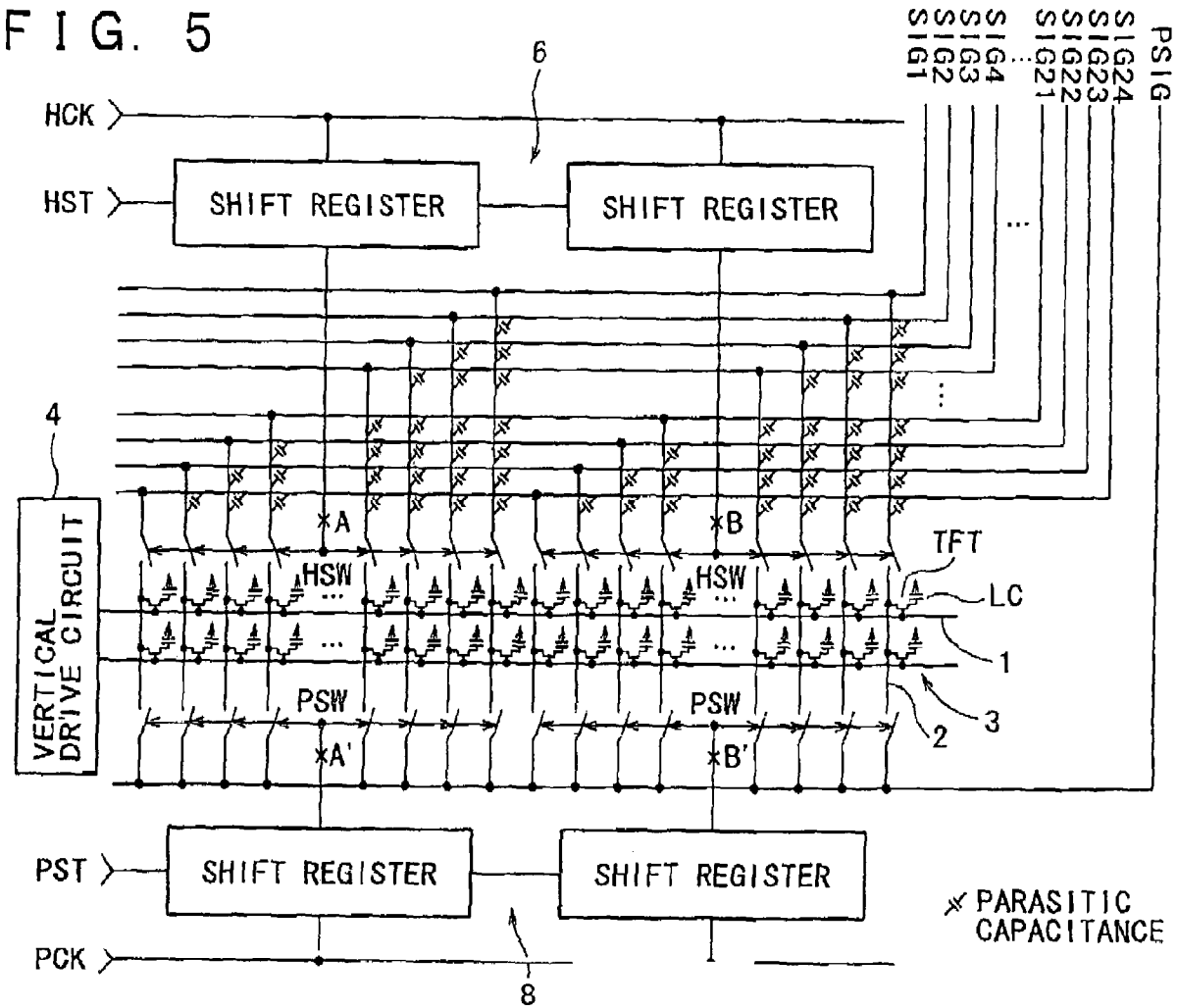
FIG. 5 is a circuit diagram showing an example of a conventional display apparatus.
Figure 6:
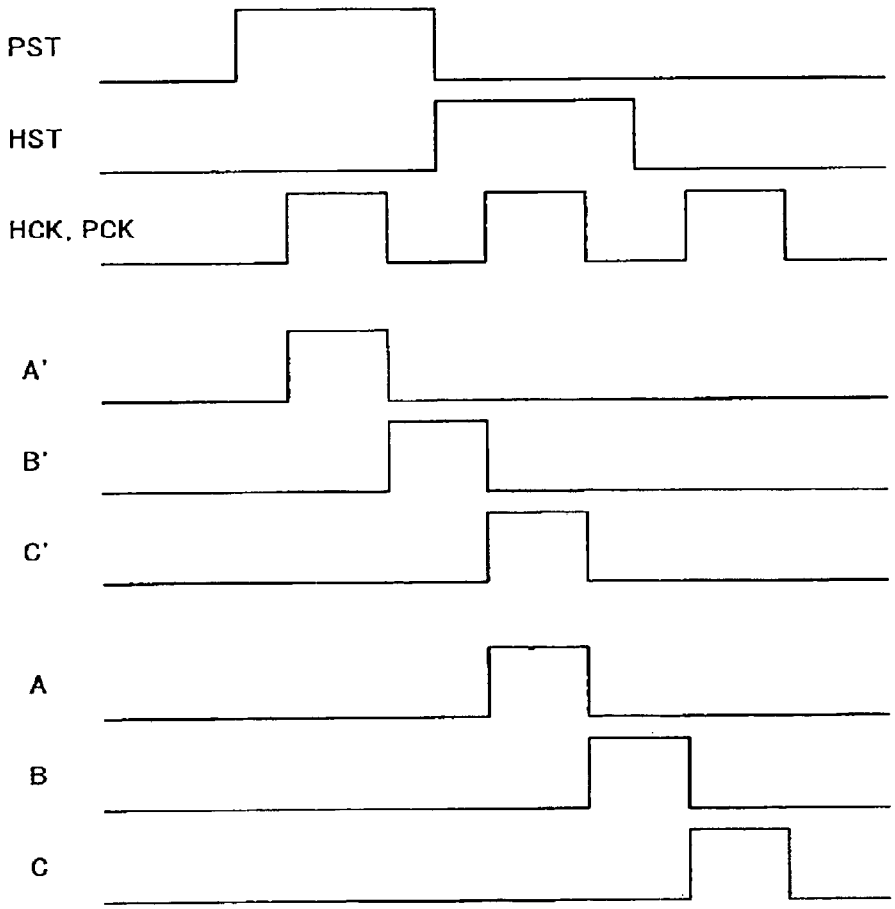
PRIOR ART FIG. 6
FIG. 6 is a timing chart illustrating operation of the display apparatus of FIG. 5.

Referring to FIG. 1, there is shown a display apparatus to which the present invention is applied. In order to facilitate understanding, in FIG. 1, like elements to those of the conventional display apparatus shown in FIGS. 4 and 5 are denoted by like reference characters. The display apparatus shown includes a pixel array section, a horizontal drive circuit, a vertical drive circuit, sampling switch sets, video lines and precharge lines. However, the vertical drive circuit is not shown in FIG. 1 in order to simplify illustration. The pixel array section includes a plurality of gate lines 1 extending in the direction of a row, a plurality of signal lines 2 extending in the direction of a column, and a plurality of pixels 3 disposed in rows and columns at points at which the gate lines 1 and the signal lines 2 intersect with each other. Each of the pixels 3 is formed from a thin film transistor TFT and a liquid crystal cell LC. However, the present invention is not limited to the specific configuration of the pixels, but may include some other active switching element in place of the thin film transistor TFT. Further, any other electro-optical element can be used in place of the liquid crystal cell LC. In order to supply video signals SIG1 to SIG24 separated into 24 different systems in a predetermined phase relationship from each other, 24 video lines 5 are provided. However, the present invention is not limited to the specific number of video lines, but usually includes n video lines in order to supply video signals separated into n systems. The sampling switch set includes switches HSW disposed corresponding to the signal lines 2. More particularly, the switches HSW of the sampling switch set are provided in a unit of 24 switches HSW disposed between 24 ones of signal lines and the 24 video lines 5. The horizontal drive circuit includes a shift register having multiple stages. It is to be noted, however, that, in FIG. 1, only one of stages of a shift register is shown. The horizontal drive circuit drives 24 switches HSW simultaneously to sample the 24 systems of video signals SIG1 to SIG24 to corresponding 24 ones of the signal lines 2. Further, the horizontal drive circuit performs such sampling successively for each 24 signal lines 2 thereto write the video signals SIG1 to SIG24 into the pixels 3 of the selected row. In FIG. 1, only one set of 24 switches HSW and only one set of 24 signal lines 2 are shown. The circuitry described corresponds to one stage of the shift register of the horizontal drive circuit.

The display apparatus of the embodiment according to the present invention is characterized in that the 24 video lines 5 are laid out in two groups, that is, in two upper and lower side groups. The video lines 5 of the upper side group are connected to the respectively corresponding signal lines 2 through the corresponding switches HSW while also the video lines 5 of the lower side group are connected to the respectively corresponding signal lines 2 through the corresponding switches HSW. In particular, in the arrangement shown in FIG. 1, one of each two adjacent ones of the signal lines 2 is connected to one of the video lines 5 of the upper side group while the other one of the two adjacent signal lines 2 is connected to one of the video lines 5 of the lower side group. Corresponding to this, also the horizontal drive circuit is divided into two upper and lower side horizontal drive circuits 6U and 6D. The upper side horizontal drive circuit 6U samples video signals SIG1, SIG3, . . . , SIG23 from the video lines 5 of the upper side group to corresponding even-numbered ones of the signal lines 2 while the lower side horizontal drive circuit 6D samples video signals SIG2, SIG4, . . . , SIG24 from the video lines 5 of the lower side group to corresponding odd-numbered ones of the signal lines 2.

Also the precharge lines 7 for supplying a predetermined PSIG are disposed separately on the upper and lower sides of the pixel array section. Therefore, also a set of precharging switches PSW is disposed separately on the upper and lower sides of the pixel array section in a similar manner to the switches HSW. However, different from the conventional display apparatus described hereinabove with reference to FIG. 5, no precharge drive circuit is provided separately, but each of the upper and lower side horizontal drive circuits 6U and 6D serves as a precharge drive circuit. In particular, the upper side horizontal drive circuit 6U applies a precharge signal through the upper side precharge line 7 and the switches PSW to the corresponding odd-numbered ones of the signal lines 2. Meanwhile, the lower side horizontal drive circuit 6D applies the precharge signal through the lower side precharge lines 7 and the switches PSW to the corresponding odd-numbered signal lines 2. Therefore, the upper side horizontal drive circuit 6U applies a drive pulse A outputted from the preceding stage side beforehand to the switches PSW and then applies another drive pulse C outputted from the pertaining stage of the shift register to the switches HSW. Consequently, the precharge signal PSIG is sampled first, and then the video signals SIG can be sampled. This similarly applies also to the lower side horizontal drive circuit 6D.

Figure 2:
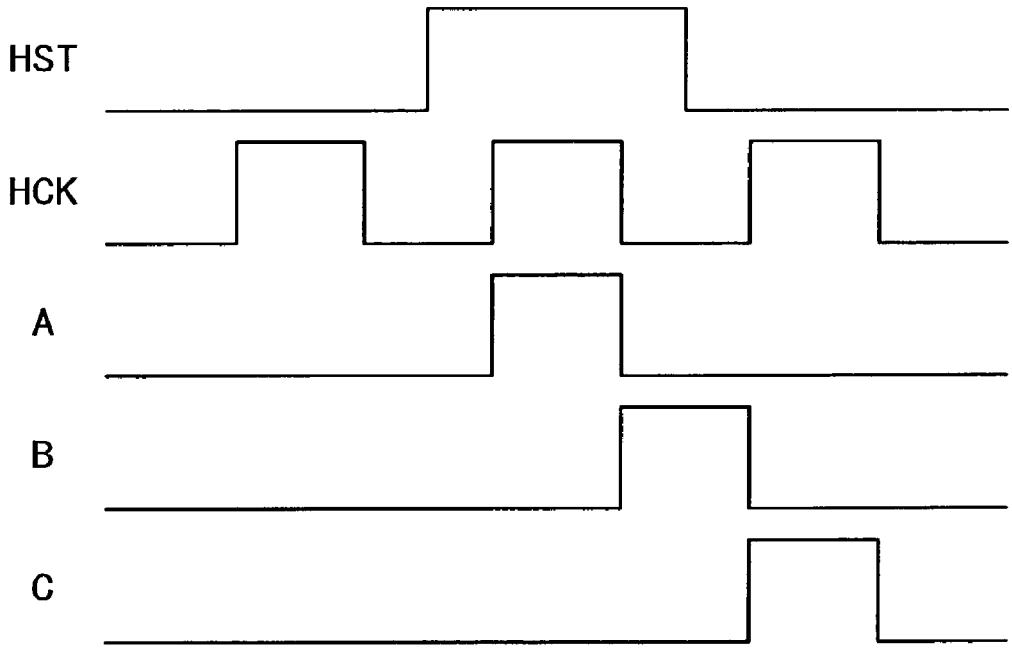
FIG. 2 is a waveform diagram illustrating operation of the display apparatus of FIG. 1.

FIG. 2 illustrates operation of the display apparatus described above with reference to FIG. 1. Referring to FIG. 2, an operation clock signal HCK and a start pulse HST are supplied to the upper side horizontal drive circuit 6U. Consequently, the upper side horizontal drive circuit 6U transfers the start pulse HST in response to the operation clock signal HCK and successively outputs drive pulses A, B, C, . . . . Also the lower side horizontal drive circuit 6D operates quite similarly in synchronism with the upper side horizontal drive circuit 6U and successively outputs drive pulses A, B, C, . . . . In the arrangement shown in FIG. 1, at a point of time when the drive pulse A is outputted from the preceding stage of the shift register, the 24 switches PSW open at a time, whereupon the precharge signal PSIG is sampled simultaneously from the 24 signal lines 2. Thereafter, when the drive pulse C is outputted from the pertaining stage later by a one-stage interval, the 24 switches HSW open at a time, whereupon the video signals SIG1 to SIG24 of the 24 separate systems are sampled simultaneously by the corresponding 24 signal lines 2.

As described above, the 24 video lines are laid out separately on the upper and lower sides within the panel and allocated to the horizontal drive circuits (scanners) divided separately and disposed on the upper and lower sides similarly. According to the present arrangement, since the number of overlaps of each video line is decreased to one half that of the conventional arrangement, also the parasitic capacitance of each video line is decreased to one half, and consequently, the ghost margin can be increased. In order to divisionally lay out the video lines on the upper and lower sides, for example, the odd-numbered signal lines input the video signals to the pixels from the upper side while the even-numbered signal lines input the video signals to the pixels from the lower side. In other words, one of each two adjacent ones of the video signal lines is connected to one of the video lines disposed on the upper side while the other of the two adjacent video signal lines is connected to the video lines disposed on the lower side. In this manner, if the upper side video lines and the lower side video lines supply video signals of the opposite polarities to each other, then dot inversion or dot line inversion driving is performed with the pixel array section, and the polarities of video signals sampled to adjacent signal lines are opposite to each other. On the other hand, since video signals of the same polarity are supplied to the video lines on the upper side, the parasitic capacitance value felt by each video line does not increase, and the ghost margin upon dot line inversion driving can be raised. Similarly, video signals of the same polarity are supplied also to the video lines on the lower side.

In the display apparatus of the embodiment shown in FIG. 1, also the precharge lines are laid out separately on the upper and lower sides. This improves the symmetry in the upward and downward direction of precharging. In this instance, the horizontal driving circuits disposed separately on the upper and lower sides on the panel have a role of a conventional precharging circuit. As described above, in the display apparatus of the embodiment of FIG. 1, drive pulses outputted from the pertaining stage of the shift register are applied to the switches HSW whereas a drive pulse outputted from a preceding stage of the shift register is applied to the switches PSW. Consequently, a switch HSW and a switch PSW connected to the same pixel can be switched on/off at different timings. In particular, the switches PSW can be switched on prior to the switches HSW. It is to be noted that, in order to make the resistances of the upper and lower side wiring lines equal to each other, the video lines on the lower side of the panel which have longer wiring line lengths are preferably formed with greater widths than those of the video lines on the upper side.

Figure 3:
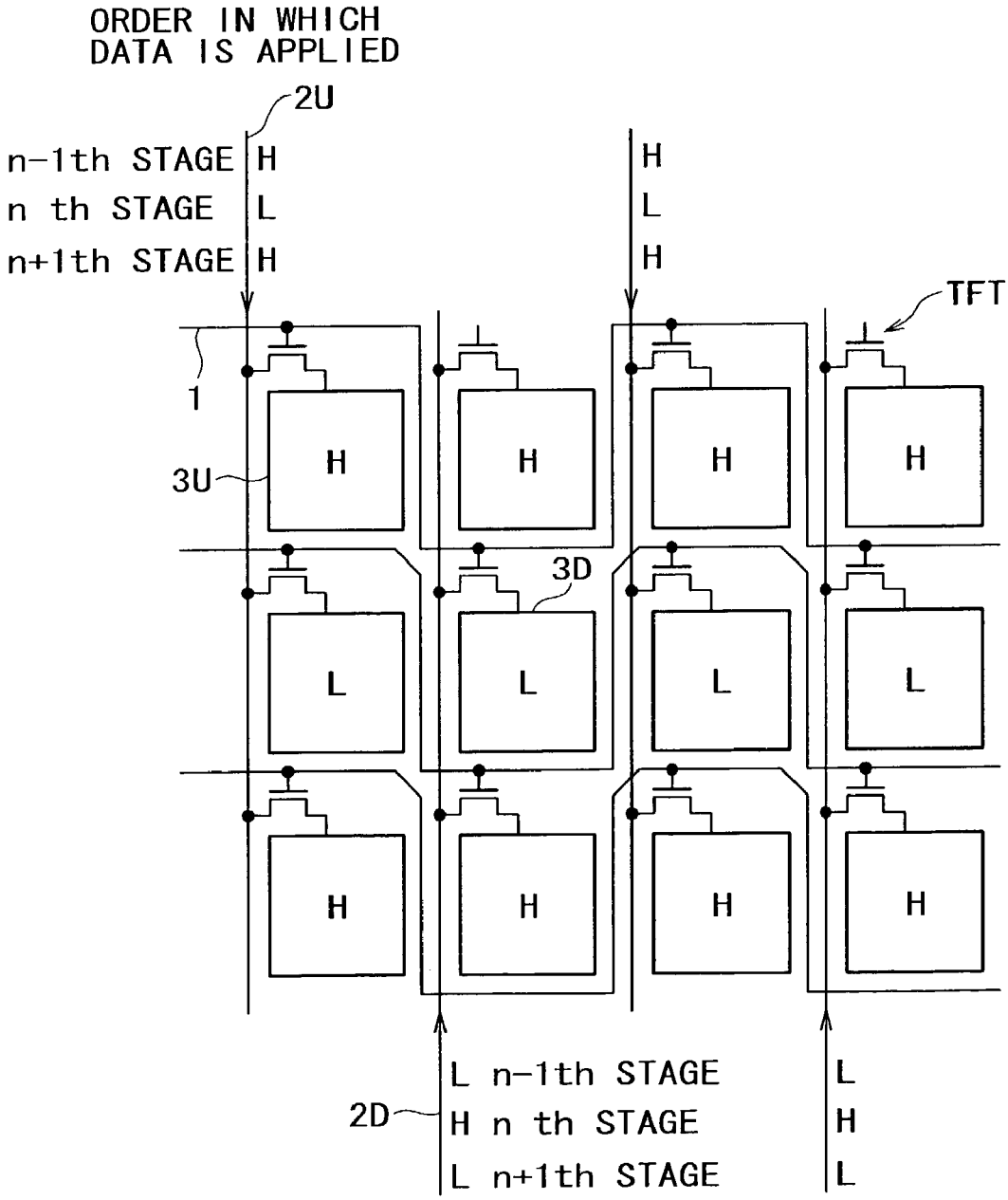
FIG. 3 is a schematic view showing a principal portion of another embodiment for the display apparatus according to the present invention.

FIG. 3 shows a modification to the display apparatus of the embodiment described hereinabove with reference to FIG. 1. Referring to FIG. 3, the modified display apparatus adopts a pixel array section ready for the dot line inversion system in place of an ordinary pixel array section wherein pixels are disposed in a grating-line configuration. One of signal lines 2U and 2D which are adjacent each other is connected to one of the video lines (not shown) disposed on the upper side while the other is connected to one of the video lines (not shown) disposed on the lower side. In the pixel array section, each gate line 1 is disposed for a unit of two rows spaced by a distance of an odd number of rows between adjacent pixel columns. In the specific arrangement shown in FIG. 3, each gate line 1 is disposed for a unit of two rows spaced by a distance of one row and is laid out in a meandering fashion for each one column between pixels of two rows. The horizontal drive circuits (not shown) disposed separately on the upper and lower sides write video signals H and L of the opposite polarities to each other into adjacent pixels 3U and 3D connected to the same gate line 1 through the corresponding signal lines 2U and 2D.

While a preferred embodiment of the present invention has been described using specific terms, such description is for illustrative purposes only, and it is to be understood that changes and variations may be made without departing from the spirit or scope of the following claims.

What is claimed is:

1. A display apparatus for performing plural pixel simultaneous sampling, comprising:

a pixel array section including a plurality of gate lines extending in a direction of a row, a plurality of signal lines extending in a direction of a column, and a plurality of pixels arranged in rows and columns at points at which said gate lines and said signal lines intersect with each other;

a vertical drive circuit connected to said gate lines for successively selecting said rows of said pixels;

n video lines divided into upper and lower side groups of video lines disposed on the upper and lower sides of said pixel array section, respectively, for supplying n video signals separated in a predetermined phase relationship from each other;

a sampling switch set including a plurality of switches divided into upper and lower side groups respectively disposed on the upper and lower sides of said pixel array section for said signal lines such that said upper side video lines are connected to corresponding ones of said signal lines through the switches of said upper side group while said lower side video lines are connected to corresponding ones of said signal lines through the switches of said lower side group and such that each signal line is connected to only one of said upper side video lines and said lower side video lines via said sampling switch set; and a pair of upper and lower side horizontal drive circuits for successively driving said switches of said sampling switch set such that each ones of the switches of said upper side group are driven simultaneously to sample the video signals of systems from said upper side video lines to the switches to write the video signals into the pixels of the selected row while each ones of the switches of said lower side group are driven simultaneously to sample the video signals of systems from said lower side video lines to the switches to write the video signals into the pixels of the selected row; and upper and lower side precharge lines disposed on the upper and lower sides of said pixel array section each for supplying a predetermined precharge signal and wherein the upper side precharge line is connected through switches of said upper side group to the corresponding signal lines, while said lower side precharge line is connected through switches of said lower side group to the corresponding signal lines, wherein one of each two adjacent ones of said signal lines is connected to one of said video lines of the upper side group while the other of the two adjacent signal lines is connected to one of said video lines of the lower side group; and wherein each of said gate lines in said pixel array section is disposed for a unit of two rows of said pixels between a pair of adjacent ones of said columns of said pixels, and said upper and lower side horizontal drive circuits write video signals of the opposite polarities to each other to adjacent ones of said pixels connected to a same gate line through the corresponding ones of said signal lines; and wherein said upper side horizontal drive circuit samples the video signals of a same polarity from said video lines of the upper side group to corresponding ones of said signal lines while said lower side horizontal drive circuit samples the video signals of a same polarity from said video lines of the lower side group to corresponding ones of said signal lines thereby to suppress the level of parasitic capacitance to be felt by each of said upper and lower side video lines to raise a margin against ghost.

2. A display apparatus according to claim 1, wherein prior to the sampling of the n video signals, a prior-stage upper side horizontal drive circuit causes the upper side precharge line to be connected through switches of said upper side group to the corresponding signal lines, while a prior-stage lower side horizontal drive circuit causes the lower side precharge line to be connected through switches of said lower side group to the corresponding signal lines, thereby applying a pre-charge signal to the n signal lines prior to sampling of the video signals.

3. The display apparatus according to claim 1, wherein n is at least 24.

4. A display apparatus for performing plural pixel simultaneous sampling, comprising:

a pixel array section including a plurality of gate lines extending in a direction of a row, a plurality of signal lines extending in a direction of a column, and a plurality of pixels arranged in rows and columns at points at which said gate lines and said signal lines intersect with each other;

a vertical drive circuit connected to said gate lines for successively selecting said rows of said pixels;

n video lines divided into upper and lower side groups o video lines disposed on the upper and lower sides of said pixel array section, respectively, for supplying n video signals separated in a predetermined phase relationship from each other;

a sampling switch set including a plurality of switches divided into upper and lower side groups respectively disposed on the upper and lower sides of said pixel array section for said signal lines such that said upper side video lines are connected to corresponding ones of said signal lines through the switches of said upper side group while said lower side video lines are connected to corresponding ones of said signal lines through the switches of said lower side group and such that each signal line is connected to only one of said upper side video lines and said lower side video lines via said sampling switch set; and a pair of upper and lower side horizontal drive circuits for successively driving said switches of said sampling switch set such that each ones of the switches of said upper side group are driven simultaneously to sample the video signals of systems from said upper side video lines to the switches to write the video signals into the pixels of the selected row while each ones of the switches of said lower side group are driven simultaneously to sample the video signals of systems from said lower side video lines to the switches to write the video signals into the pixels of the selected row, and a pair of upper and lower side precharge lines disposed on the upper and lower sides of said pixel array section each for supplying a predetermined precharge signal and wherein the upper side precharge line is connected through switches of said upper side group to the corresponding signal lines, while said lower side precharge line is connected through switches of said lower side group to the corresponding signal lines.

5. The display apparatus according to claim 4, wherein one of two adjacent signal lines which are connected to the same gate line through respective pixels is connected to one of said video lines of the upper side group while the other of the two adjacent signal lines is connected to one of said video lines of the lower side group.

6. The display apparatus according to claim 4, wherein n is at least 24.

7. A display apparatus according to claim 4, wherein prior to the sampling of the n video signals, a prior-stage upper side horizontal drive circuit causes the upper side precharge line to be connected through switches of said upper side group to the corresponding signal lines, while a prior-stage lower side horizontal drive circuit causes the lower side precharge line to be connected through switches of said lower side group to the corresponding signal lines, thereby applying a pre-charge signal to the n signal lines prior to sampling of the video signals.

8. A display apparatus for performing plural pixel simultaneous sampling, comprising:

a pixel array section including a plurality of gate lines extending in a direction of a row, a plurality of signal lines extending in a direction of a column, and a plurality of pixels arranged in rows and columns at points at which said gate lines and said signal lines intersect with each other;

a vertical drive circuit connected to said gate lines for successively selecting said rows of said pixels;

n video lines divided into upper and lower side groups of video lines disposed on the upper and lower sides of said pixel array section, respectively, for supplying n video signals separated in a predetermined phase relationship from each other;

a sampling switch set including a plurality of switches divided into upper and lower side groups respectively disposed on the upper and lower sides of said pixel array section for said signal lines such that said upper side video lines are connected to corresponding ones of said signal lines through the switches of said upper side group while said lower side video lines are connected to corresponding ones of said signal lines through the switches of said lower side group and such that each signal line is capable of being connected to only one of said upper side video lines and said lower side video lines via said sampling switch set; and a pair of upper and lower side horizontal drive circuits for successively driving said switches of said sampling switch set such that each ones of the switches of said upper side group are driven simultaneously to sample the video signals of systems from said upper side video lines to the switches to write the video signals into the pixels of the selected row while each ones of the switches of said lower side group are driven simultaneously to sample the video signals of systems from said lower side video lines to the switches to write the video signals into the pixels of the selected row.

9. The display apparatus according to claim 8, further comprising a pair of upper and lower side precharge lines disposed on the upper and lower sides of said pixel array section each for supplying a predetermined precharge signal to a pixels in the selected row, and wherein the upper side precharge line is connected through switches of said upper side group to the corresponding signal lines, while said lower side precharge line is connected through switches of said lower side group to the corresponding signal lines.

10. The display apparatus according to claim 9, wherein prior to the sampling of the video signals, a prior-stage upper side horizontal drive circuit causes the upper side precharge line to be connected through switches of said upper side group to the corresponding signal lines, while a prior stage lower side horizontal drive circuit causes the lower side precharge line to be connected through switches of said lower side group to the corresponding signal lines, thereby applying a pre-charge signal to the signal lines prior to sampling of the video signals.

* * * * *